US006558074B2

(12) United States Patent
Jansson

(10) Patent No.: US 6,558,074 B2
(45) Date of Patent: May 6, 2003

(54) ASSEMBLY OF REVETMENTS WITH CRUSH-ABSORBING RIBS

(76) Inventor: Jan Erik Jansson, 814 S. Sierra Ave., Solana Beach, CA (US) 92075-2616

( * ) Notice: Subject to any disclaimer, the term of this patent is extended or adjusted under 35 U.S.C. 154(b) by 0 days.

(21) Appl. No.: 09/909,425

(22) Filed: Jul. 19, 2001

(65) Prior Publication Data

US 2003/0017000 A1 Jan. 23, 2003

(51) Int. Cl.[7] ..... E02B 3/12; E02B 3/14

(52) U.S. Cl. ..... 405/16; 405/15; 405/20; 52/604; 404/37

(58) Field of Search ..... 405/15–20, 25, 405/30, 35; 52/89, 600, 603, 604, 606; 404/17, 34, 37, 38, 41, 42, 45

(56) References Cited

U.S. PATENT DOCUMENTS

| | | | | | |
|---|---|---|---|---|---|
| 869,566 | A | * | 10/1907 | Hawkins | 405/20 |
| 929,723 | A | | 8/1909 | Taylor | |
| 1,164,707 | A | | 12/1915 | Edinger | |
| 2,876,628 | A | | 3/1959 | Dixon, Jr. | |
| 3,903,702 | A | | 9/1975 | Appleton | |
| 4,370,075 | A | * | 1/1983 | Scales | 405/20 |
| 4,375,928 | A | * | 3/1983 | Crow et al. | 405/20 |
| 4,564,311 | A | * | 1/1986 | Scales | 405/20 |
| 4,661,012 | A | | 4/1987 | McCloskey | |
| 5,224,792 | A | | 7/1993 | Hagenah | |
| 5,484,230 | A | | 1/1996 | Rudloff | |
| 5,556,228 | A | * | 9/1996 | Smith | 405/16 |
| 5,632,571 | A | | 5/1997 | Mattox | |
| 5,779,391 | A | | 7/1998 | Knight | |
| 5,906,456 | A | | 5/1999 | Knight | |
| 6,071,041 | A | | 6/2000 | Knight | |

FOREIGN PATENT DOCUMENTS

| | | | | |
|---|---|---|---|---|
| FR | 1265140 | | 10/1961 | |
| GB | 2167795 | * | 6/1986 | 405/16 |
| JP | 03267419 | * | 11/1991 | 405/16 |

* cited by examiner

*Primary Examiner*—Jong-Suk (James) Lee
(74) *Attorney, Agent, or Firm*—Wood, Phillips, Katz, Clark & Mortimer

(57) ABSTRACT

In an assembly of predominantly concrete revetment, each revetment is a generally rectangular solid having two longitudinal margins and two transverse margins, having two expansive faces, and having an array of apertures, which extend through said revetment, between the expansive faces, and through which vegetation can grow. Each revetment has a grid of embedded reinforcing bars, which include a reinforcing bar extending within each of its longitudinal and transverse margins. Each revetment has, on each of its longitudinal and transverse margins, one or more ribs extending between its expansive faces. At each rib on each of its longitudinal margins or at each rib on each of its longitudinal and transverse margins, each revetment has a cable passage extending through such rib and through the longitudinal margins has such rib and opening into a near aperture of the array of apertures of said revetment. The revetments are connected to one another, via cables passing through at least some of the cable passages of the connected revetments, so that at least some of the ribs of the connected revetments approximate one another. The approximating ribs are adapted to become crushed, so as to minimize crushing of the connected revetments except at the approximating ribs, if and when the assembly is articulated at the approximating ribs.

7 Claims, 3 Drawing Sheets

ASSEMBLY OF REVETMENTS WITH CRUSH-ABSORBING RIBS

TECHNICAL FIELD OF THE INVENTION

This invention pertains to a predominantly concrete revetment and to an assembly of said revetments, as employed to line embankments, stream beds, and driveways for emergency vehicles. Each revetment has cable passages extending through crush-absorbing ribs on margins of such revetment.

BACKGROUND OF THE INVENTION

As exemplified in older patents including U.S. Pat. No. 2,876,628 and in newer patents including U.S. Pat. Nos. 5,108,222, 5,632,571, and 5,779,391, assemblies of predominantly concrete revetments are employed to line embankments, stream beds, and driveways for emergency vehicles. A reinforced plastic revetment of related interest is disclosed in U.S. Pat. No. 929,728.

As exemplified in U.S. Pat. No. 2,876,628 and in U.S. Pat. No. 5,779,391, cables are employed to connect the respective revetments of such an assembly to one another, whereby the assembly is articulated. As exemplified in U.S. Pat. No. 5,108,222 and U.S. Pat. No. 5,632,571, a polymeric grid is employed to connect the respective revetments of such an assembly to one another, whereby the assembly is articulated.

A revetment of related interest is disclosed in U.S. Pat. No. 5,224,792. As disclosed therein, the revetment has projecting spacers that abut or interlock with projecting spacers on an adjacent, similar revetment.

SUMMARY OF THE INVENTION

This invention provides a novel assembly of predominantly concrete revetments and a novel revetment for such an assembly. As discussed below, each revetment has a novel arrangement of ribs, through which cable passages extend.

Each revetment is a generally rectangular solid having two longitudinal margins and two transverse margins, having two expansive faces, and having an array of apertures, which extend through said revetment, between the expansive faces, and through which vegetation can grow. Each revetment has a grid of embedded reinforcing bars. Each revetment has, on each of the longitudinal margins of said revetment or on each of the longitudinal and transverse ribs of said revetment, one or more ribs extending between the expansive faces of said revetment.

Each revetment has, at each rib on each of the longitudinal margins of said revetment or on each rib on each of the longitudinal and transverse margins of said revetment, a cable passage extending through said rib and through whichever of the margins has said rib, the cable passage opening into a near aperture of the array of apertures of said revetment. The reinforcing bars include a reinforcing bar extending through each of the margins having a rib with a cable passage. The revetments of the assembly are connected to one another, via cables passing through at least some of the cable passages of the connected revetments, so that at least some of the ribs of the connected revetments approximate one another. The approximating ribs are adapted to become crushed, so as to minimize crushing of the connected revetments except at the approximating ribs, if and when the assembly is articulated at the approximating ribs.

DESCRIPTION OF THE ILLUSTRATED EMBODIMENTS

Figure 1:
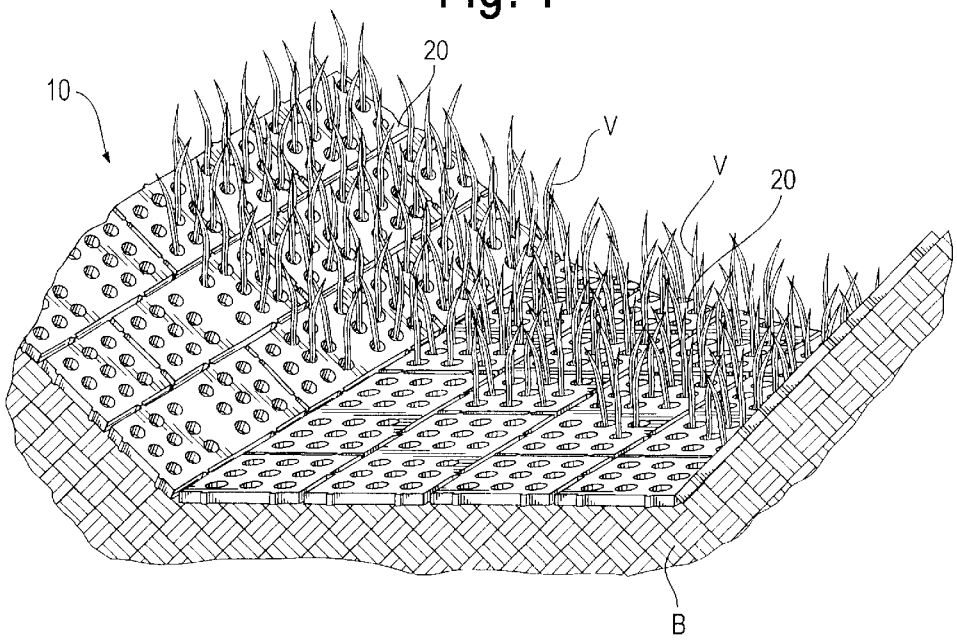
FIG. 1 is a fragmentary, perspective view of an assembly of predominantly concrete revetments of a first type embodying this invention, as employed to line a stream bed.

As shown in FIG. 1, an assembly 10 of predominantly concrete revetments 20 of a first type embodying this invention, each appearing to be generally rectangular in plan view, is employed to line a stream bed B, from which vegetation V grows. In the assembly 10, the revetments 20 are arranged in staggered rows and most of the revetments 20 are full-sized, while some of the revetments 20 are half-sized and appear to be generally square when viewed from above. Although the half-sized revetments 20 are placed ordinarily at the ends of alternate rows, two half-sized revetments 20 can replace one full-size revetment 20. The assembly 10 is articulated where inclined revetments 20 of the assembly 10 and horizontal revetments 20 of the assembly 10 are connected.

Each revetment 20 is cast in a casting form (not shown) so as to conform to a generally rectangular solid having two longitudinal margins 22 and two transverse margins 24, an upper, expansive face 26, a lower, expansive face 28, and an array of apertures 30, which extend through said revetment 20, between the expansive faces 26, 28, and through which vegetation V can grow. The respective margins 22, 24, are tapered and the apertures 30 are conical, so that said revetment 20 can be easily removed from the casting form when the casting form is inverted. Each full-size revetment 20 has, halfway between its transverse margins 24, a section 32 without such apertures 30, the section 32 being located approximately where two half-size revetments 20 would approximate each other if the half-size revetments 20 replaced said full-size revetment 20. Each revetment 20 may be slightly rounded at its respective edges. Although it is preferred that the apertures 30 are conical, the apertures 20 in each revetment may be otherwise shaped.

As cast, each revetment 20 has a grid of steel reinforcing bars (rebars) embedded within said revetment 20, including reinforcing bars 40 extending longitudinally and transversely between apertures 30 of the array of apertures 30 of said revetment 20, including a reinforcing bar 42 extending longitudinally within each of the longitudinal margins 22 of said revetment 20, and including a reinforcing bar 44 extending transversely within each of the transverse margins 24 of said revetment 20. Ordinarily, common steel rebars are useful for the grid. However, for some applications wherein corrosion is undesirable, galvanized steel rebars or stainless steel rebars may be instead used.

Each revetment 20 has, on each of its longitudinal margins 22, two generally vertical ribs 50 spaced longitudinally from each other and extending between the expansive faces 26, 28, of said revetment 20. Each revetment 20 has, at each rib 50, a cable passage 52 extending transversely through said rib 50 and through whichever of the longitudinal margins 22 has said rib 50 and opening into a near aperture 30 of the array of apertures 30 of said revetment 20. Each revetment 20 has, on each of its transverse margins 24, two generally vertical ribs 54 spaced transversely from each other and extending between the expansive faces 26, 28, of said revetment 20.

The revetments 20 of the assembly 10 can be individually placed onto an embankment, into a stream bed, or onto a driveway for emergency vehicles. In the assembly 10, the revetments 20 are connected to one another, via cables 60 passing through at least some of the cable passages 52 of the connected revetments 20, so that at least some of the ribs 50 on the longitudinal margins 22 of the connected revetments 20 approximate one another. Consequently, as shown, at least some of the ribs 54 on the transverse margins 24 of the connected revetments 20 approximate one another. Thus, along the respective margins 22, 24, of the connected revetments 20, elongate apertures 70 are defined, through which vegetation V can grow.

Figure 3:
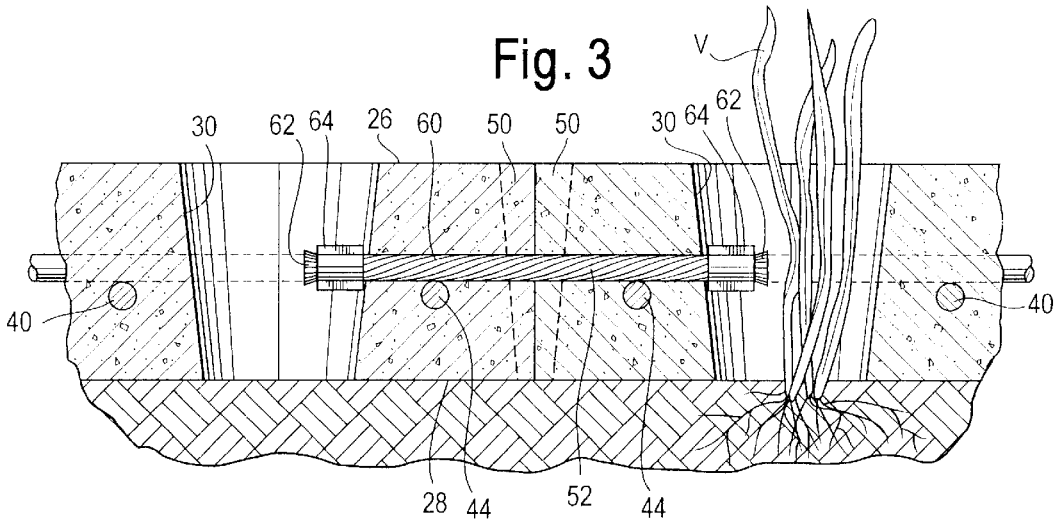
FIG. 3, on a larger scale compared to FIG. 2, is a fragmentary, cross-sectional detail showing how two revetments of the assembly are connected to one another, via a cable.

As shown in FIG. 3, at each of its opposite ends 62, each cable 60 has a ferrule 64, which is crimped so as to prevent said cable 60 from being pulled from the cable passages 52 passing said cable 60. Alternatively, each cable 60 may be suitably joined at its opposite ends 62, after said cable 60 has been passed through the cable passages 58 intended to pass said cable 60, so as to define a closed loop (not shown) connecting two revetments 20 of the assembly 10 to each other.

Whether the cables 60 are crimped at their ends 62 or are joined at their ends 62 so as to define closed loops, the reinforcing bars 42, 44, along the respective margins 22, 24, of the revetments 20 resist breakage of the revetments 20 where the revetments 20 are joined by the cables 60. Moreover, if one cable 60 should break, the other cables 60 prevent disassembly of the assembly 10 before the broken cable 60 is replaced. Usually, the broken cable 60 can be readily replaced without removal, displacement, or disruption of the assembly 10.

Figure 4:
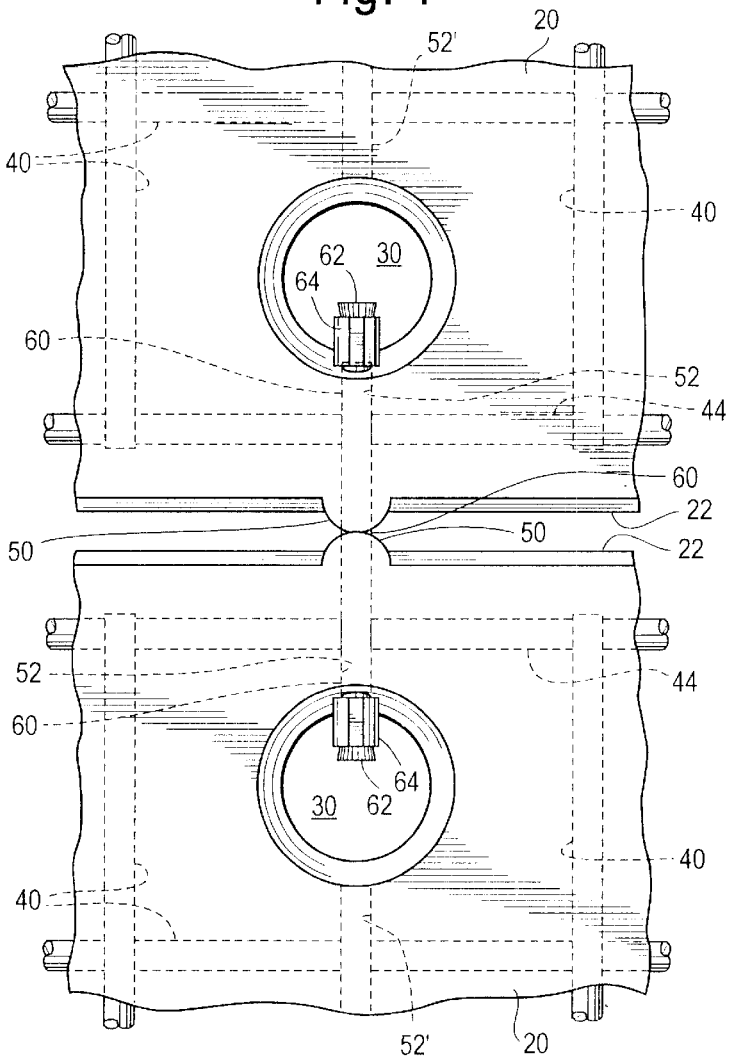
FIG. 4, on a similar scale compared to FIG. 3, is a fragmentary, enlargement of a region outlined FIG. 2.

Alternatively, if the cable passages 52 extend completely through the revetments where indicated at 52' in FIG. 4, the cables 60 can pass completely through the revetments 20. Thus, the assembly 10 can be pre-assembled from any feasible number of the revetments 20, in any feasible pattern, before the assembly 10 is placed by a crane (not shown) or otherwise onto an embankment, into a stream bed, or onto a driveway for emergency vehicles.

The approximating ribs 52, 54, are adapted to become crushed, so as to minimize crushing of the connected revetments 20 except at the approximating ribs 52, if and when the assembly 10 is articulated at the approximating ribs 52, 54. Thus, where the assembly 10 is articulated, crushing of the longitudinal margins 22, 24, of the connected revetments 20 is minimized. Moreover, and desirably, the approximating ribs 52, 54, retard water flow between the connected revetments 20.

Figure 2:
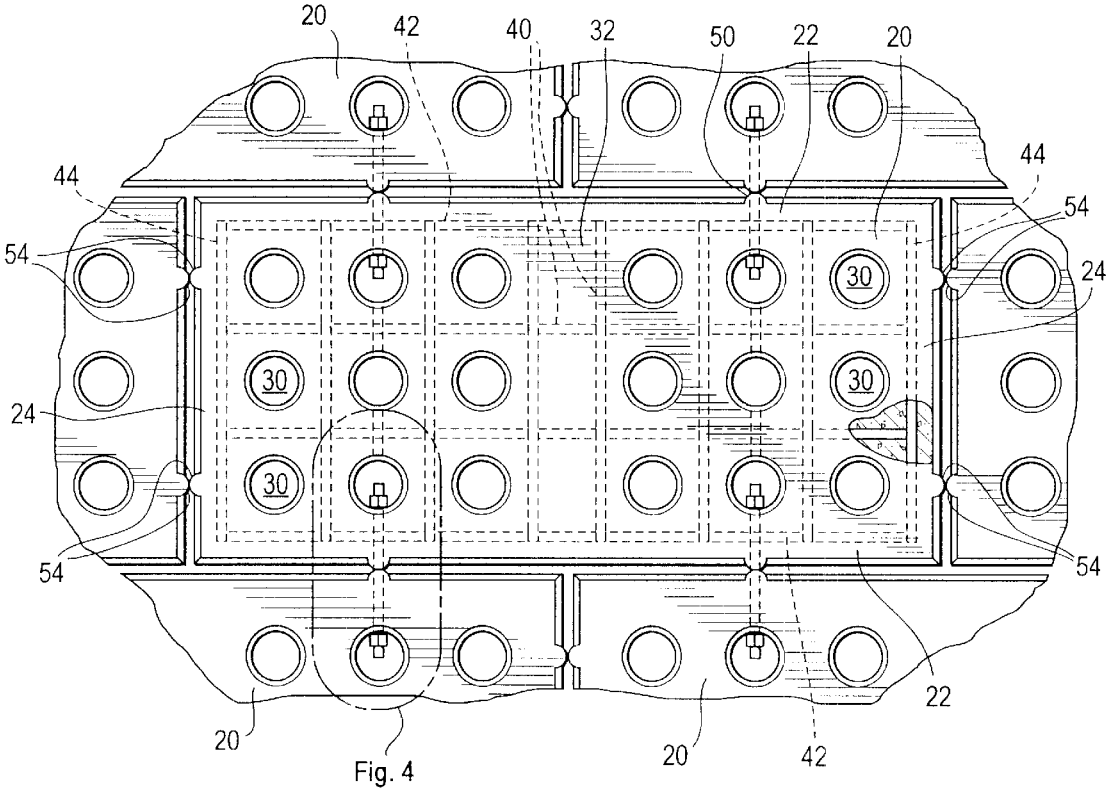
FIG. 2, on a larger scale compared to FIG. 1, is a fragmentary, plan view of the assembly, apart from the stream bed.

As shown in FIG. 2, in an assembly 10' of predomoninantly concrete revetments 20' of a second type embodying this invention, each revetment 20' is similar to one of the half-sized revetments 20 of the first assembly 10, except as shown in FIG. 2 and described below.

Each revetment 20' has an array of apertures 30', which are similar to the apertures 30 of the first assembly 10, two longitudinal margins 22' and two transverse margins 24'. Each revetment 20' has a grid of steel reinforcing bars (rebars) embedded within said revetment 20. The reinforcing bars include reinforcing bars 40' extending longitudinally and transversely between apertures 30' of the array of apertures 30' of said revetment 20', a reinforcing bar 42' extending longitudinally through each of the longitudinal margins 22 of said revetment 20', and a reinforcing bar 44' extending transversely through each of the transverse margins 24' of said revetment 20'.

Each revetment 20' has, on each of its longitudinal margins 22', one generally vertical rib 50' and has, on each of its transverse margins 24', one generally vertical rib 54'. Each revetment 20' has, at each rib 50', a cable passage 52' extending transversely through said rib 50' and through whichever of the longitudinal margins 22' has said rib 50' and opening into a near aperture 30' of the array of apertures 30' of said revetment 20'. Each revetment 20' has, at each rib 54', a cable passage 56' extending transversely through said rib 54' and through whichever of the transverse margins 24' has said rib 54' and opening into a near aperture 30' of the array of apertures 30' of said revetment 20'.

Te revetments 20' of the second assembly 10' are connected to one another, via cables 60' passing through at least some of the cable passages 52' of the connected revetments 20' and via cables 70' passing through at least some of the cable passages 56' of the connected revetments 20', so that at least some of the ribs 50' on the longitudinal margins 22 of the connected revetments 20 approximate one another and so that at least some of the ribs 54' on the transverse margins 24' of the connected revetments 20' approximate one another. Thus, along the respective margins 22', 24', of the connected revetments 20', elongate apertures 70' are defined, through which vegetation V can grow.

Figure 5:
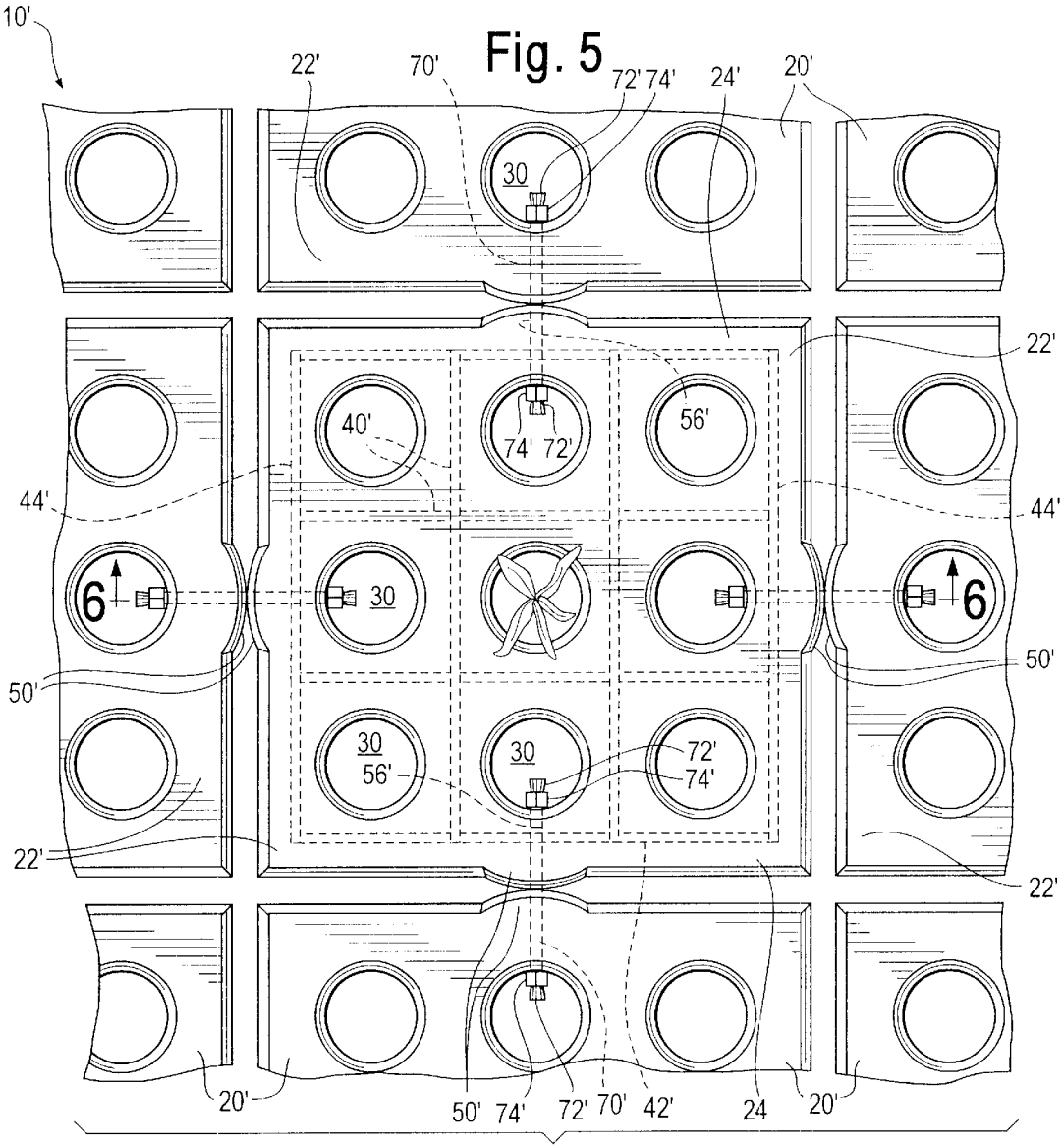
FIGS. 5 and 6, which are views analogous to FIGS. 2 and 3 respectively, show an assembly of predominantly concrete revetments of a second type embodying this invention.
Figure 6:
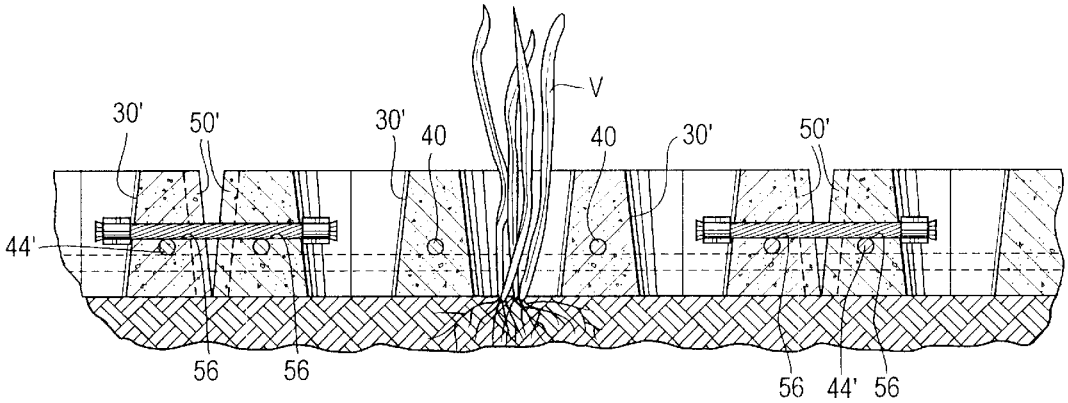

As shown in FIG. 5, at each of its opposite ends 62', each cable 60' has a ferrule 64', which is crimped so as to prevent said cable 60' from being pulled from the cable passages 52' passing said cable 60'. Moreover, at each of its opposite ends 72' each cable 70' has a ferrule 74', which is crimped so as to prevent said cable 70' from being pulled from the cable passages 56' passing said cable 70'. Alternatively, each cable 60, 70, may be suitably joined at its opposite ends 62, 72', in a manner described in connection with the first assembly 10.

The approximating ribs 52', 54', are adapted to become crushed, so as to minimize crushing of the connected revetments 20' except at the approximating ribs 52', 54', if and when the assembly 10' is articulated at the approximating ribs 52', 54'. Thus, where the assembly 10' is articulated, crushing of the respective margins 22', 24', of the connected revetments 20 is minimized. Moreover, and desirably, the approximating ribs 52', 54', retard water flow between the connected revetments 20'.

For some applications, in which the revetments 20, 20', are not expected to be displaced, the cables are unnecessary and may be optionally omitted, along with the cable passages.

What is claimed is:

1. An assembly of revetments, each revetment being a generally rectangular solid having two longitudinal margins and two transverse margins, having two expansive faces, and having an array of apertures, which extend through said revetment, between the expansive faces, and through which vegetation can grow, wherein each revetment has a grid of embedded reinforcing bars, which include certain of the reinforcing bars extending between certain of the apertures of the array of apertures of said revetment, and which include one of the reinforcing bars extending longitudinally within each of the longitudinal margins of said revetment, wherein each revetment has, on each of the longitudinal and transverse margins of said revetment, at least one rib extending between the expansive faces of said revetment, each revetment having, at each rib, a cable passage extending through said rib and through the longitudinal margin at said rib, the cable passage extending into a near aperture of the array of apertures of said revetment, and wherein the revetments of the assembly are connected to one another, via cables passing through at least some of the cable passages of the connected revetments, so that at least some of the ribs of the connected revetments approximate one another, the approximating ribs being adapted to become crushed, so as to minimize crushing of the connected revetments except at the approximating ribs, if and when the assembly is articulated at the approximating ribs.

2. The assembly of claim 1 wherein each revetment has, on each of the longitudinal and transverse margins of said revetment, a single rib extending between the expansive faces of said revetment.

3. The assembly of claim 2 wherein the revetments of the assembly are connected to one another, in staggered rows, so that each of the revetments of the assembly is connected to two or more other revetments of the assembly.

4. An assembly of revetments, each revetment being a generally rectangular solid having two longitudinal margins and two transverse margins, having two expansive faces, and having an array of apertures, which extend through said revetment, between the expansive faces, and through which vegetation can grow, wherein each revetment has a grid of embedded reinforcing bars, which include certain of the reinforcing bars extending between certain of the apertures of the array of apertures of said revetment, and which include one of the reinforcing bars extending longitudinally within each of the longitudinal margins of said revetment, wherein each revetment has, on each of the longitudinal margins of said revetment, longitudinally spaced ribs extending between the expansive faces of said revetment, each revetment having, at each rib on each of the longitudinal margins of said revetment, a cable passage extending through said rib and through the longitudinal margin having said rib, the cable passage extending into a near aperture of the array of apertures of said revetment, and wherein the revetments of the assembly are connected to one another, via cables passing through at least some of the cable passages of the connected revetments, so that at least some of the ribs of the connected revetments approximate one another, the approximating ribs being adapted to become crushed, so as to minimize crushing of the connected revetments except at the approximating ribs, if and when the assembly is articulated at the approximating ribs.

5. The assembly of claim 4 wherein each revetment has, on each of the transverse margins of said revetment, transversely spaced ribs extending between the expansive faces of said revetment.

6. The assembly of claim 5 wherein the revetments of the assembly are connected to one another, in staggered rows, so that each of the revetments of the assembly is connected to two or more other revetments of the assembly.

7. The assembly of claim 4 wherein the revetments of the assembly are connected to one another, in staggered rows, so that each of the revetments of the assembly is connected to two or more other revetments of the assembly.

* * * * *